United States Patent [19]

Antonious

[11] Patent Number: 4,826,172

[45] Date of Patent: May 2, 1989

[54] GOLF CLUB HEAD

[76] Inventor: Anthony J. Antonious, 205 E. Joppa Rd., Towson, Md. 21204

[21] Appl. No.: 25,094

[22] Filed: Mar. 12, 1987

[51] Int. Cl.[4] ..... A63B 53/04

[52] U.S. Cl. ..... 273/169; 273/164; 273/167 H; 273/80 A

[58] Field of Search ..... 273/169, 167 R, 167 F, 273/170, 171, 164, 80 A, 167 H, 172, 173, 174; D21/220

[56] References Cited

U.S. PATENT DOCUMENTS

| | | | |
|---|---|---|---|
| D. 229,434 | 11/1973 | Irower | 273/167 F X |
| D. 267,965 | 2/1983 | Kobayashi | D21/220 |
| 2,087,685 | 7/1937 | Harkney | 273/167 F |
| 2,231,847 | 2/1941 | Dickson et al. | 273/80 A |
| 2,691,525 | 10/1954 | Callaghan | 273/167 R |
| 2,846,228 | 8/1958 | Reach | 273/167 F |
| 3,814,437 | 6/1974 | Winguist | 273/167 R |
| 4,128,244 | 12/1978 | Duclos | 273/164 |
| 4,136,877 | 1/1979 | Antonious | 273/164 |
| 4,325,553 | 4/1982 | Taylor | 273/171 |
| 4,355,808 | 10/1982 | Jernigan et al. | 273/169 |
| 4,508,350 | 4/1985 | Duclos | 273/169 |
| 4,511,145 | 4/1985 | Schmidt | 273/169 |
| 4,569,523 | 2/1986 | Jarvis | 273/169 |
| 4,621,813 | 11/1986 | Solheim | 273/169 |

*Primary Examiner*—George J. Marlo

*Attorney, Agent, or Firm*—N. J. Aquilino

[57] ABSTRACT

A perimeter weighted iron-type golf club head with a recessed or cavity back and a peripheral mass having an improved weight configuration formed of weight members within the cavity which are positioned adjacent to and on opposite sides of the center of percussion of the golf club head and located between the center of percussion and the peripheral mass of the golf club head.

8 Claims, 3 Drawing Sheets

GOLF CLUB HEAD

BACKGROUND OF THE INVENTION

1. Field of the Invention

The present invention relates to perimeter weighted golf club heads, and more particularly to recessed or cavity back iron type perimeter weighted golf club heads, having an improved weight distribution and configuration.

2. Description of the Prior Art

Over the years, iron type golf club heads have evolved from essentially flat blades to club heads adapted to improve the efficiency and control of the clubs by using numerous designs and weight configurations. Attempts at maximizing the weight characteristics of a golf club have included providing a solid back club, providing the majority of the weight on the back of a golf club head at the heal and at the toe portion of the club head, concentrating the weight at the bottom of the golf club head, concentrating the weight at both the bottom of the club head and the heel-toe areas, and locating the weight around the periphery of the golf club head. The latter attempt provides a deep recessed cavity in the back of the club head which is centrally located in the back of the club head.

Although the evolution of iron type golf club head designs has produced improvements over the original flat blades, the newer club head designs have limitations in distance, feel and control. For example, conventional iron-type heads with solid backs provide a solid feel but less distance and accuracy when miss-hit. Conventional cavity back clubs are more forgiving when the golfer miss-hits the ball, but they still sacrifice appreciable distance and accuracy when miss-hit. The other prior art iron-type club head designs have exhibited deficiencies in distance, feel and/or control.

SUMMARY OF THE INVENTION

The present invention overcomes the problems and disadvantages of the prior art by providing peripheral weighted iron type golf club heads and having a recessed or cavity back with additional weight members designed and positioned to provide increased control and feel, without sacrificing accuracy and distance.

An object of the present invention is to provide a peripheral weighted iron type golf club which permits a golfer to achieve improved control, feel, accuracy, and distance.

Another object is to provide an iron type golf club head design that minimizes variances of the ball's flight when a ball is hit off-center, without sacrificing accuracy and distance of the ball's flight.

Still another object is to improve the playing performance of perimeter weighted golf club heads, particularly of the iron type, wherein a cavity in the back of the club head is defined by peripheral mass providing perimeter weighting of the club head by maximizing off-center hits of a golf ball, causing the ball to go farther and straighter when struck off the center of percussion of the club head.

In particular, an object of the present invention is to improve upon peripheral mass, perimeter weighting club head systems by having weight members between the club's center of percussion and the peripheral mass of the club head at points which are located adjacent to the center of percussion and are positioned at areas where golf balls are more frequently struck when the percussion center is missed. The additional weight members are optimally located and provide an increased stability and mass configuration causing miss-hit golf balls to travel farther and straighter and with a proper trajectory.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a weighting system for an iron-type golf club head including a hosel, a heel, a toe, an upper surface, a lower surface, a rear surface, a ball striking face, a complementary rear face, and a center of percussion, the weighting system comprising a peripheral mass formed on at least the heel, toe and lower surface portions of the outer periphery of the rear surface of the club head, the peripheral mass defining a cavity at the rear surface of the club head and providing a perimeter weighting for the club head, and at least two opposing weight members formed at the rear surface of the club head, the respective opposing weight members being located on opposite sides of the center of percussion and being positioned between the center of percussion and opposing sides of the peripheral mass.

Several embodiments of the present invention are contemplated. A first embodiment adds weighting members which are generally vertically disposed within the cavity in the back of the golf club head. The weights are positioned to the left and right of the center of percussion in the adjacent regions where most miss-hits are made. In other embodiments, the vertical members extend in a vertical direction to the top of the golf club head or extend beyond the top of the golf club head.

Still other embodiments use a plurality of weight members which are disposed within the cavity on the back of the golf club head and which generally surround the center of percussion so as to be located between the center of percussion and the peripheral mass of the club head.

The accompanying drawings, which are incorporated in and constitute a part of this specification, illustrate several embodiments of the invention and, together with the description, serve to explain the principles of the invention.

DESCRIPTION OF THE PREFERRED EMBODIMENTS

Figure 1:
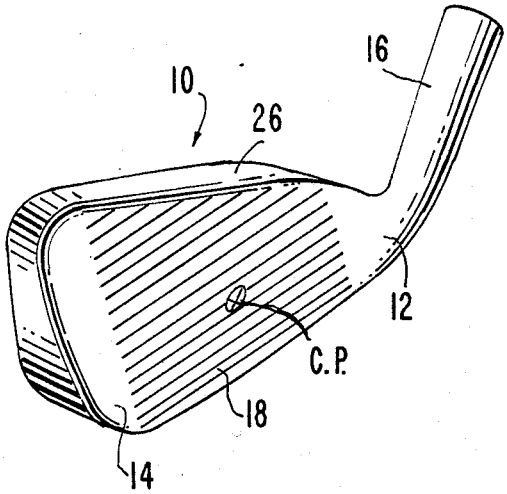
FIG. 1 is a front perspective view of a golf club head in accordance with the present invention.

Reference will now be made in detail to the present preferred embodiments of the invention, examples of which are illustrated in the accompanying drawings. Wherever possible, the same or like reference numbers will be used throughout the drawings to refer to the same or like parts.

FIGS. 1 through 4 illustrate one embodiment of a golf club head 10 of the present invention. The golf club head 10 is an iron type including a heel 12, toe 14, hosel 16, and ball striking face 18, and a complementary rear face 20. As illustrated in the drawings, the club head 10 has a center of percussion CP shown on the ball striking face 18 and also on the rear face 20 of the club head. As is known in the art, the center of percussion CP is located at approximately the center of the club head and is the spot where a ball should be struck to provide maximum distance and control. The club head 10 includes a rear recess or cavity 22 and which is defined by a peripheral mass 24 which concentrates the weight of the club head around the periphery of the club head as illustrated particularly in FIG. 2. The cavity bottom forms a rear wall 25 and an inner rear lower surface 29. The club head includes a top ridge surface 26 and bottom sole or lower surface 28.

In the recess or cavity-type club head shown in FIGS. 1-4, and all of the embodiments shown, the peripheral mass 24 projects outwardly away from the rear face 20 of the club head forming a top rear surface 24*a*, side rear surfaces 24*b* and 24*c*, and bottom rear surface 24d. As shown in this particular embodiment, the peripheral mass 24 is wider (in direction W shown in FIG. 4) at the bottom rear surface 24*d* than at the top rear surface 24*a*, and consequently the depth of the cavity 22 at the bottom of the rear wall 25 is greater than the depth of the cavity at the top of the rear wall 25. Although the peripheral weighting design shown in the figures includes some degree of recess between the top rear surface 24*a* and the rear face 20, the present invention also is directed toward club heads having a perimeter weighting design in which the rear face and the top of the club head are substantially flush. Club heads with such a perimeter weighting configuration are known to those skilled in the art.

To enhance the feel, control and performance of the club head, elongated weight members 30 and 32 are located between the center of percussion CP and the rear surface sides 24*b* and 24*c* of peripheral mass 24 and extend upwardly from the inner rear lower surface 29 of the cavity bottom. In the embodiment shown in FIGS. 1-4, the weight members 30 and 32 are vertically disposed with respect to the bottom sole 28 of the club head 10 and a line 27 defining the longitudinal axis of the club head in a heel 12 to toe 14 direction. When the club head is properly soled in preparation for hitting the ball, the weight members 30 and 32 are substantially in vertical alignment with the ground. The weight members 30 and 32 are located adjacent to and on opposite sides of the center of percussion CP of the club head. In this embodiment, the weight members 30 and 32 extend from the inner wall of the peripheral mass 24 at the bottom of the club head upwardly to the inner wall of the peripheral mass 24 at the top of the club head 10. The weight members 30 and 32 preferably are integrally molded as parts of the club head, and each member is connected both to the top 24*a* and bottom 24d of the peripheral mass and to the rear face 20 of the club head.

Figure 2:
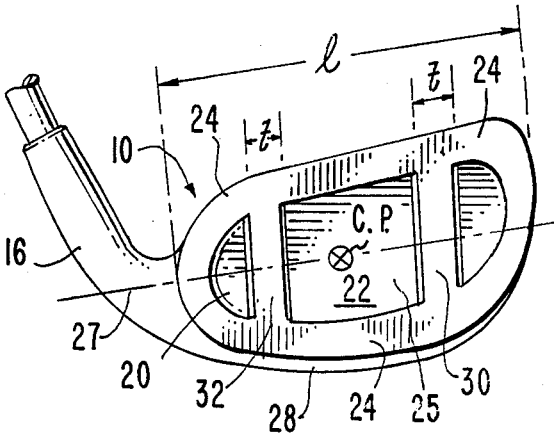
FIG. 2 is a rear perspective view of a golf club head of FIG. 1.
Figure 4:
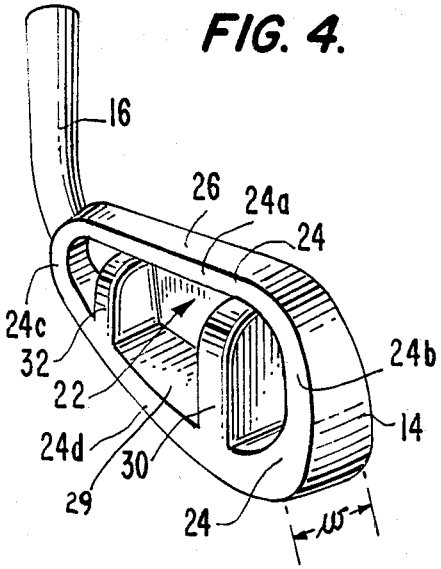
FIG. 4 is a rear perspective view of the golf club head of FIG. 1.
Figure 3:
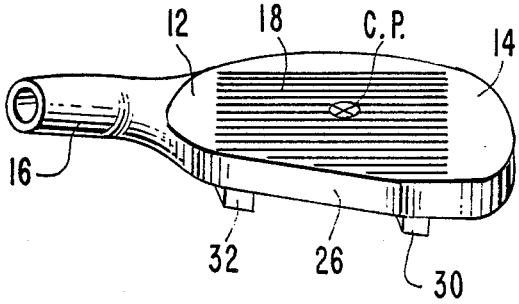
FIG. 3 is a top plan view of the golf club head of FIG. 1.

An example of an embodiment of the invention shown in FIGS. 1-4, which has been made and tested by applicant, is a 7-iron type club head having longitudinal length of $3\frac{1}{4}$ inches, with both members 30 and 32 having a thickness of $\frac{1}{4}$ inch (along line 27), shown in FIG. 2. Member 32 has a vertical length of $\frac{3}{4}$ inch, and the right side of member 32 is spaced 7/16 inch from the center of percussion CP. Member 30 has a vertical length of 1 inch, and the left side of member 30 is spaced $\frac{5}{8}$ inch from the center of percussion CP. The rear wall 25 is recessed $\frac{1}{2}$ inch from the bottom rear surface 24*d* of the peripheral mass and is recessed $\frac{3}{8}$ inch from the top rear surface 24*a* of the peripheral mass 24. As shown in FIG. 3, the weight members 30 and 32 project outwardly beyond the top edge 26.

The club head illustrated in FIGS. 1-4 is designed and proportioned so that the weight of the entire club head is within the weight range of conventional club heads. As a result, the club head has a total weight and swing weight within those used and accepted by golfers. The inventor achieves this result by eliminating an amount of material and mass from the periphery of the club head that is substantially equal to the amount of material and mass added by weights 30 and 32. It should be apparent that the present invention also contemplates the elimination of material from various parts of a conventional club head and the addition of some or all of the eliminated material or weight in the form of weight members adjacent to and on opposite sides of the center of percussion. For example, weight could be eliminated from the striking face and added in the form of weight members.

The weight members of the present invention, such as members 30 and 32, provide a golfer with a more solid feel, concentrate the mass of the club head behind the point of impact with the ball, and increase the control of the club, particularly if a ball is hit off-center. If the ball is hit at the center of percussion, substantially the full force and distance benefits of perimeter weighting will be provided. On the other hand, if the ball is hit off-center to the right or left of the center of percussion, the weights 30 and 32 will maximize energy transfer to the ball and stabilize the club to provide better control with minimum loss of distance. This benefit is provided because the weights 30 or 32 are closer to where the ball is actually struck, and that additional mass decreases the tendency of the club to push or pull the ball off line and increases the direct force applied to the ball. The location of the added mass adjacent the center of percussion also significantly increases the stability of the club head caused by a miss-hit.

The size and shape of the members 30 and 32 can be varied to improve the control and accuracy of the club head for particular golfers or specific performance purposes. For example, in order to decrease the tendency of a golfer to hit the ball with the club head open and therefore push the ball, more mass can be added to member 30 than member 32. Similarly, the distance between the center of percussion CP and the member 30 can be increased. The increased mass and/or leverage will promote the closing of the club head as the golfer swings the club head into the ball. In contrast, if a golfer tends to hit the ball with the club face closed, the mass of the member 30 relative to member 32 can be decreased, or the relative positions and masses of members 30 and 32 can be altered. Thus, by adjusting the placement and mass of the members 30 and 32, one can alter the swing characteristics of the club head to promote better control. As another example, the weight members can be designed with increased weight at the top, to promote topspin, or increased weight at the bottom, to promote backspin. The adjustment of the placement and mass of the members 30 and 32 can be achieved by changing the size and/or shape of members 30 and 32, while designing those members as solid structures. On the other hand, the members 30 and 32 can be designed to have hollow compartments to which weight, in the form of powder, shot or similar materials, can be added. Similarly, the members can be designed to include threaded bores into which weight rods or screws can be selectively inserted.

Referring to FIG. 3, it also can be seen that the weight members 30 and 32 are visible when the golf club head 10 is placed on a ground surface in a normal play position. These weight members therefore aid the golfer in aligning a golf ball with the center of percussion CP of the club head 10.

The weight members in combination with the other elements of the club head also permit the golfer to experience a greater sensation or sensitivity of feel when striking a golf ball. This greater sensation or sensitivity of feel assists the golfer in all aspects of play and is particularly beneficial when loss than a full striking force is used, as with short game shots. For example, this feature of the present invention is particularly advantageous for chip shots to the green which require greater club head control and feel for more accurate shot making.

Depending upon the proposed use of the club and the desired effect, the weight distribution members 30 and 32, or similar weight members, may be of various configurations, widths and thicknesses and may be located at various positions adjacent to and on opposite sides of the center of percussion CP. Several embodiments of the present invention are illustrated in the drawings. The weight members 30 and 32 preferably are positioned, respectively, within one inch from the center of percussion CP, since these respective areas are where most miss-hits of a golf ball would occur. The weight members can be located within one-half (½) inch from the center of percussion to accommodate golfers who hit shots in the area closer to the center of percussion CP. The arrangement of the weights adjacent the center of percussion thereby provides additional mass at or near the location where miss-hit shots most frequently occur for the average golfer. As a result, the weights provide improved shot performance when a golf ball is struck off the center of percussion of the club head.

Figure 5:
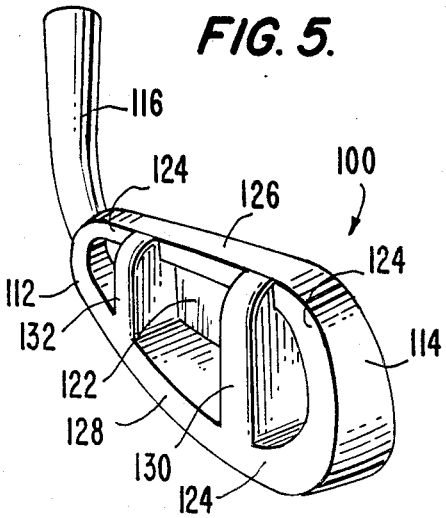
FIG. 5 is a rear perspective view of a second embodiment of a golf club head in accordance with the present invention.

FIG. 5 illustrates another embodiment of a golf club 100 in accordance with the present invention. The golf club 100 includes a heel 112, toe 114 and hosel 116. The club head 100 also includes a cavity 122, a peripheral mass 124, a top surface 126 and bottom 128. In this embodiment, the weight members 130 and 132 extend vertically from the bottom of the peripheral mass 124 beyond the cavity 122 to the top surface 126 of the club head 100. This embodiment provides more weight at the top of the club head. In addition, the members 130 and 132 provide an alignment system since they extend rearwardly beyond the top surface 126.

Figure 6:
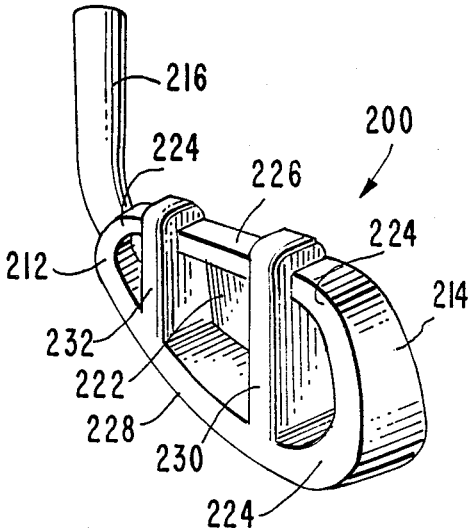
FIG. 6 is a rear perspective view of a third embodiment of a golf club head in accordance with the present invention.
Figure 7:
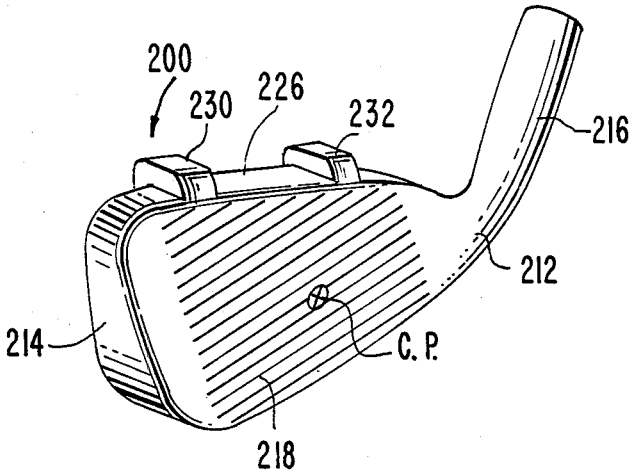
FIG. 7 is a front perspective view of the golf club head of FIG. 6.

FIG. 6 illustrates another embodiment of a golf club 200 in accordance with the present invention which is of a type similar to that illustrated in FIGS. 1–4. The club head 200 includes a heel 212, toe 214 and hosel 216. The club head 200 also includes a cavity 222, a peripheral mass 224, a top surface 226 and a bottom 228. In this embodiment, weight members 230 and 232 extend vertically from the bottom of the peripheral mass 224 and extend beyond the peripheral mass 224 of the club head 200 so they project above the top surface 226 and extend to the front face of the club head, as shown in FIGS. 6 and 7. This arrangement provides additional weight at the top of the club and also emphasizes the alignment characteristics of the weight members 230 and 232. This embodiment enables the golfer to better determine the optimum area on the club face where a golf ball ideally would be struck.

Figure 8:
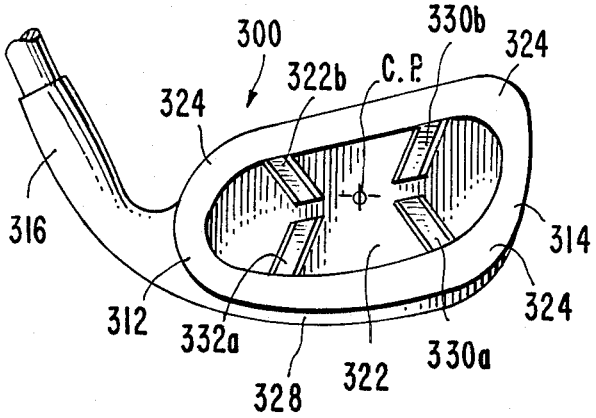
FIG. 8 is a rear perspective view of a fourth embodiment of the present invention.

FIG. 8 illustrates a fourth embodiment of a golf club head 300 of the present invention. The club head 300 includes a heel 312, toe 314 and hosel 316. The club head 300 includes a cavity 322 and peripheral mass 324. In this embodiment, four weight members **330*a* and 330*b* and 332*a* and 332*b* are shown angularly disposed with respect to the bottom 328 of the club head 300. These weight members effectively surround the center of percussion CP. As shown, the pair of weight members 330*a* and 330*b* on the right and the pair of weight members 332*a* and 332*b* on the left angle inwardly from the peripheral mass 324 in a direction toward the center of percussion CP. The pair of members 330*a* and 330*b* are connected to the respective bottom and top of the peripheral mass and the rear face of the cavity 322. These members are positioned adjacent to the center of percussion CP and are spaced from each other at the center of the cavity. The left members 332*a* and 332*b*** are similarly designed. This embodiment preferably would be used by golfers of a relatively high caliber where off-center hits are not as frequent or severe as golfers with lesser skills. This embodiment provides a more solid feel at or near the center of percussion CP when the club head impacts a golf ball.

Figure 9:
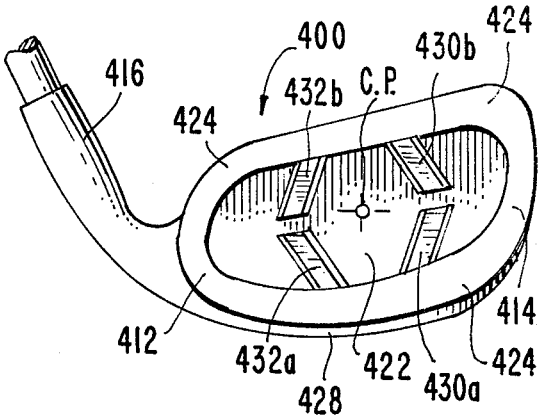
FIG. 9 is a rear perspective view of a fifth embodiment of the present invention.

FIG. 9 illustrates a fifth embodiment of a golf club head 400 of the present invention including a heel 412, toe 414, and hosel 416. This embodiment includes a cavity 422 and a peripheral mass 424 disposed around the cavity 422. Weight kmembers **430*a* and 430*b* and 432*a* and 432*b* are also angularly disposed with respect to the bottom 428 of the golf club head 400 and surround the center of percussion CP. This embodiment is similar to that shown in FIG. 8, but in this embodiment the weight members angle outwardly from the peripheral mass 424 away from the center of percussion CP of the golf club head 400**. This embodiment provides better control and feel for a golfer who miss-hits the ball more often.

Figure 10:
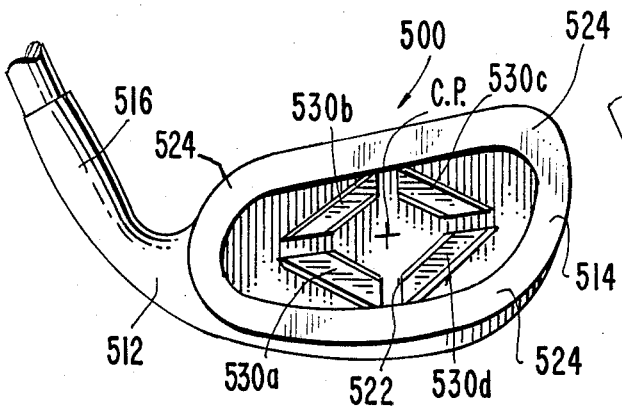
FIG. 10 is a rear perspective view of a sixth embodiment of the present invention.

FIG. 10 illustrates a sixth embodiment of a golf club head 500 of the present invention including a heel 512, toe 514, and a hosel 516. This embodiment includes a cavity 522 and a peripheral mass 524 disposed around the cavity 522. A series of diamond shaped weight members 530*a*, 530*b*, 530*c* and 530*d* are shown angularly disposed to form a diamond shaped configuration surrounding the center of percussion CP. These weight members are attached to the rear face of the cavity 522, and are spaced apart from each other.

Figure 11:
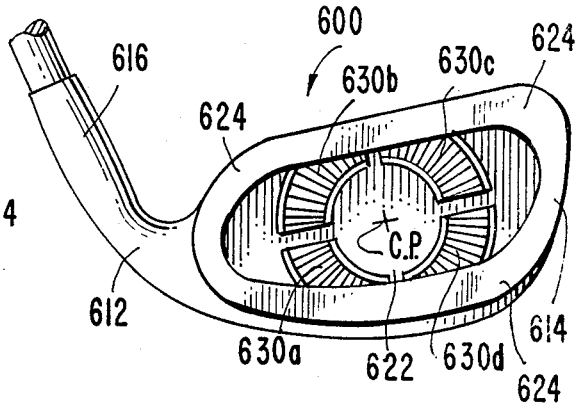
FIG. 11 is a rear perspective view of a seventh embodiment of the present invention.

FIG. 11 illustrates a seventh embodiment of the golf club head 600 of the present invention including a heel 612, toe 614, and hosel 616. This embodiment includes a cavity 622 and a peripheral mass 624 disposed around the cavity 622. Weight members 630*a*, 630*b*, 630*c* and 630*d* are formed of a series of arcuate elements disposed in a generally circular shape about the center of percussion CP. This embodiment is similar in operation and effect to the embodiment shown in FIG. 10.

Figure 12:
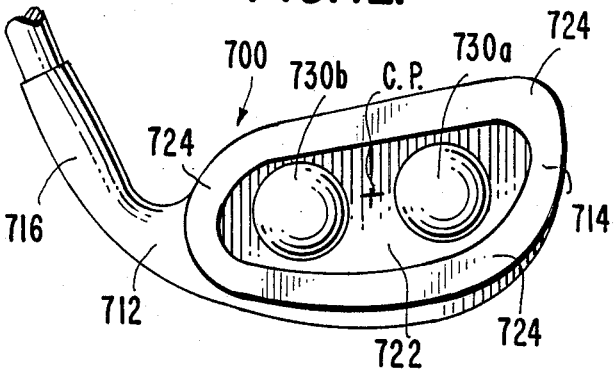
FIG. 12 is a rear perspective view of an eighth embodiment of the present invention.

FIG. 12 illustrates an eighth embodiment of the golf club head 700 of the present invention including a heel 712, toe 714, and hosel 716. This embodiment includes a cavity 722 and a peripheral mass 724 disposed around the cavity 722. A pair of cylindrically shaped weight members 730*a* and 730*b* are disposed adjacent to and on opposite sides of the center of percussion CP and between the center of percussion and the toe 714 and heel 712 of the club head 700. Because the members are spaced from each other and the peripheral mass, the cylindrical members can be sized and positioned to provide the optimum playing characteristics for a particular golfer's requirements.

Figure 13:
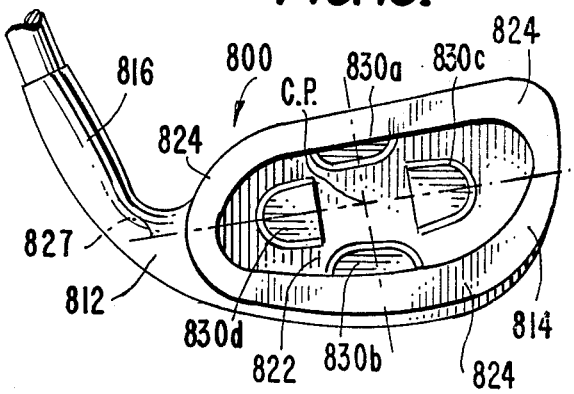
FIG. 13 is a rear perspective view of a ninth embodiment of the present invention.

FIG. 13 illustrates a ninth embodiment of the golf club head 800 of the present invention including a heel 812, toe 814, and hosel 816. This embodiment also includes a cavity 822 and a peripheral mass 824 disposed around the cavity 822. Weight members 830*a*, 830*b*, 830*c*, and 830*d* are disposed about the center of percussion CP of the club head 800. Weight members 830*a* and 830*b* fall on a line which is perpendicular to the longitudinal axis 827 of the golf club head 800 and extending through the center of percussion CP. Weight members 830*c* and 830*d* fall on a line which extends along the longitudinal axis 827 of the club head 800 and through the center of percussion CP. These weight members are spaced from the peripheral mass, are fixed to the rear face, and can be positioned and sized to provide the optimum weight distribution for the intended purpose.

Figure 14:
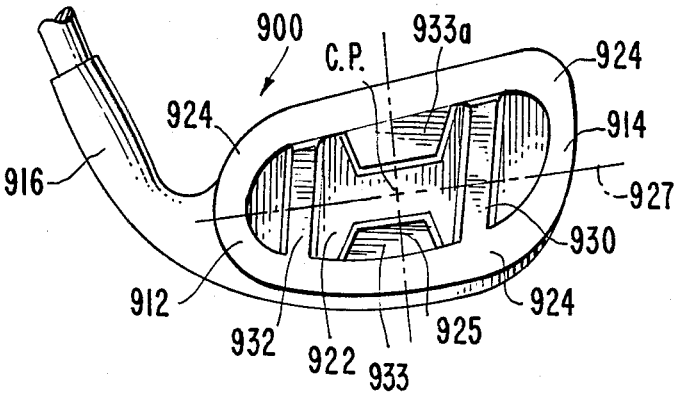
FIG. 14 is a rear perspective view of a tenth embodiment of the present invention.

FIG. 14 illustrates a tenth embodiment of a golf club head 900 of the present invention including a heel 912, toe 914, and hosel 916. This embodiment also includes a cavity 922 and a peripheral mass 924 disposed about the cavity 922. The club head 900 includes weight members 930 and 932 which are similar to those illustrated and described with respect to the embodiment of FIG. 1 through FIG. 4, except additional weights 933 and 933a are provided which are located above and below and on opposite sides of and adjacent to the center of percussion CP and between the weight members 930 and 932. Weight members 933 and 933a lie on a line 925 extending through the center of percussion CP and perpendicular to the longitudinal axis 927 of the golf club head 900. The addition of these weights adds to the feel of the club, and the weights can be sized to promote accuracy and distance.

Figure 15:
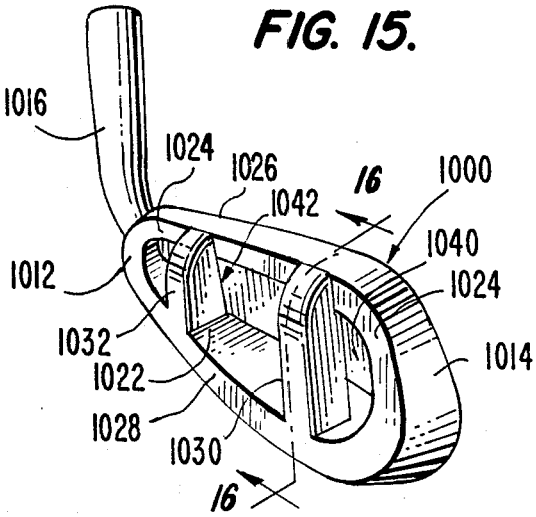
FIG. 15 is a rear perspective view of an eleventh embodiment of the present invention.
Figure 16:
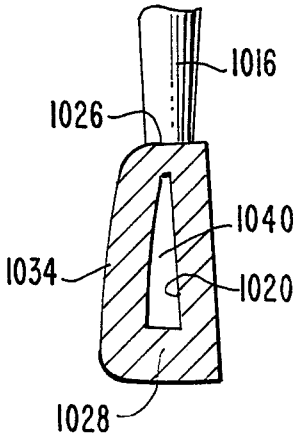
FIG. 16 is a sectional view taken along the line 16—16 of FIG. 15.

FIGS. 15 and 16 illustrate an eleventh embodiment of a golf club head 1000 of the present invention, including a heel 1012, toe 1014, and hosel 1016. The club head 1000 includes a cavity 1022, a peripheral mass 1024, a top surface 1026, and a bottom 1028. In this embodiment, a pair of weight members 1030 and 1032 extend vertically from the bottom 1028 to the top surface 1026 of the club head 1000. The weight members 1030 and 1032 extend from the top surface 1026 to the bottom 1028 and are separated from the rear surface 1020 of the club head 1000 forming gaps 1040 and 1042.

By spacing the weight members from the rear surface of the club head, a softer feel is provided when hitting a golf shot. Further, any inherent flexibility in the club face is enhanced to provide a rebounding effect with this structure while maintaining the benefits of a weighting system where the weights are disposed adjacent the center of percussion.

It will be appreciated that although the improved golf club head has been described with respect to specific embodiments, the invention shown and described in detail may include various changes and modifications without departing from the spirit and scope of the invention as defined by the appended claims.

Preferably, in each of the above embodiments, the club head and weight members are molded or otherwise manufactured as a single integral unit. The invention, however, obviously also contemplates designs in which the weight members are fixed to the club head by various conventional means, such as epoxies, screws, and so forth.

I claim:

1. A weighting system for an iron type golf club head including a hosel, a heel, a toe, a bottom sole, a top ridge, a rear surface including a rear upper surface and a rear lower surface, a ball striking face having a center of percussion, a peripheral mass formed on said rear surface adjacent at least said heel, toe, and bottom sole of said club head on the outer periphery thereof, said peripheral mass defining a cavity formed within said peripheral mass, said cavity having a bottom planar in shape and forming an inner rear lower surface behind said ball striking face, the outer rear edge of said peripheral mass forming an outer rear surface; and at least two opposing weight members extending from said rear upper surface to said lower rear surface and being located apart from and on opposite sides of said center of percussion between said center of percussion and opposing sides of said peripheral mass, said weight members being futher characterized by being located on said inner rear lower surface and extending between said rear lower surface and said rear upper surface of said club head, said weight members projecting above said inner rear lower surface of said cavity to at least said outer rear surface located on said peripheral mass and providing a stabilizing means between said center of percussion and said peripheral mass for providing improved energy transfer to a golf ball being struck off the center of percussion.

2. The weighting system of claim 1 wherein said elongated elements are spaced from the rear surface.

3. An iron type golf club head having an improved weighting system, said club head having a hosel, a heel, a toe, a bottom, an upper surface, a lower surface, a rear, a ball striking face, and a center of percussion; said weighting system comprising a peripheral mass formed on the rear of said club head said peripheral mass being located on at least the heel, toe, and lower surface of said club head, said peripheral mass defining a cavity at the rear of said club head; said weighting system further including a pair of vertically disposed weight members located on the rear of said club head and on opposite sides of said center of percussion between the center of percussion and the opposing sides of said peripheral mass, said weight members being spaced from said center of percussion and said peripheral mass and extending from said peripheral mass at said lower surface upwardly to said upper surface of said club head, said weight members providing a stabilizing means between said center of percussion and said peripheral mass for providing improved energy transfer to a golf ball struck off the center of percussion.

4. The golf club head of claim 3 wherein said weight members form the furthermost rear surface of said golf club head.

5. An iron type golf club head with an improved weighting configuration including a hosel, a heel, a toe, an upper surface, a lower surface, a rear surface, a ball striking face, and a center of percussion characterized by a plurality of cavities formed in said rear surface; said plurality of cavities including a first cavity being located adjacent said heel, a second cavity being located adjacent said toe, and a third cavity centrally located rearwardly of said center of percussion, said cavities being formed by peripheral masses on at least said heel, said toe and said lower surface portions of the outer periphery of said rear surface of the club head, and a pair of vertically disposed masses extending between said upper surface and said lower surface, said vertical masses being further defined by one of said vertical masses being located between said center of percussion and said toe and the second of said vertical masses being located between said center of percussion and said heel of said club head.

6. The club head of claim 5 where a first of said vertically disposed masses is located between said first cavity adjacent said heel and said third cavity centrally located and a second of said vertically disposed masses is located between said second cavity adjacent said toe and said third cavity centrally located.

7. The weighting system of claim 5 wherein said vertical masses extend from the bottom of the cavity beyond the top surface of the golf club head.

8. A weighting system for an iron type golf club head including a hosel, a heel, a toe, an upper surface, a lower surface, a rear surface, ball striking face, a complementary rear face, and a center of percussion; the weighting system comprising:

a peripheral mass formed on at least the heel, toe and lower surface portions of the outer periphery of the rear surface of the club head, said peripheral mass defining a cavity at the rear surface of the club head and providing a perimeter weighting for the club head; and at least two opposing weight members formed on the rear surface of the club head and extending outwardly from said rear surface to at least the rearmost outer surface of said peripheral mass, the respective opposing weight members being located on opposite sides of and spaced from the center of percussion, one weight member being positioned between and spaced from the center of percussion and the toe portion of said peripheral mass, the second opposing weight member being positioned between and spaced from the center of percussion and the heel portion of said peripheral mass, said first and second weight members providing a mass for improved club head stabilization and energy transfer to a golf ball struck off the center of percussion.

* * * * *